US011486399B2

(12) United States Patent
Wahl

(10) Patent No.: US 11,486,399 B2
(45) Date of Patent: Nov. 1, 2022

(54) INTERNAL GEAR PUMP

(71) Applicant: Schwäbische Hüttenwerke Automotive GmbH, Aalen-Wasseralfingen (DE)

(72) Inventor: Thomas Wahl, Ertingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 144 days.

(21) Appl. No.: 16/779,805

(22) Filed: Feb. 3, 2020

(65) Prior Publication Data

US 2020/0248693 A1 Aug. 6, 2020

(30) Foreign Application Priority Data

Feb. 4, 2019 (DE) ..... 10 2019 102 745.4

(51) Int. Cl.
*F04C 29/02* (2006.01)
*F04C 2/10* (2006.01)

(52) U.S. Cl.
CPC ..... *F04C 29/021* (2013.01); *F04C 2/10* (2013.01); *F04C 29/025* (2013.01)

(58) Field of Classification Search
CPC ..... F04C 2/10; F04C 29/025
USPC ..... 418/102
See application file for complete search history.

(56) References Cited

U.S. PATENT DOCUMENTS

2004/0261587 A1* 12/2004 Ernesti ..... B25B 23/0071 81/180.1
2007/0253855 A1* 11/2007 Tsubono ..... F04C 2/084 418/61.3
2009/0175751 A1* 7/2009 Nakayoshi ..... F04C 2/102 418/171

* cited by examiner

*Primary Examiner* — Connor J Tremarche
(74) *Attorney, Agent, or Firm* — RatnerPrestia

(57) ABSTRACT

An internal gear pump for forward and reverse operations, including: a pump housing which includes a first fluid port and a second fluid port, wherein in a first rotational direction, the first fluid port is formed as a fluid outlet and the second fluid port is formed as a fluid inlet, and in a second rotational direction, the first fluid port is formed as a fluid inlet and the second fluid port is formed as a fluid outlet; an internal gear and an external gear which together form delivery cells in order to deliver a fluid; a first rotary bearing which mounts the internal gear; and a second rotary bearing which mounts the external gear; and includes a lubricant feed which sets a fluid flow between the fluid ports through the two rotary bearings in both rotational directions.

17 Claims, 3 Drawing Sheets

INTERNAL GEAR PUMP

CROSS REFERENCE TO RELATED APPLICATIONS

This application claims priority to German Patent Application No. 10 2019 102 745.4, filed Feb. 4, 2019, the contents of such application being incorporated by reference herein.

FIELD OF THE INVENTION

The invention relates to an internal gear pump for forward and reverse operations, comprising a pump housing which comprises a first fluid port and a second fluid port, wherein in a first rotational direction, the first fluid port is formed as a fluid outlet and the second fluid port is formed as a fluid inlet, and in a second rotational direction, the first fluid port is formed as a fluid inlet and the second fluid port is formed as a fluid outlet. The pump also comprises: an internal gear and an external gear which together form delivery cells in order to deliver a fluid; a first rotary bearing which mounts the internal gear; a second rotary bearing which mounts the external gear; and a lubricant feed which sets a fluid flow between the fluid ports through the two rotary bearings in both rotational directions.

SUMMARY OF THE INVENTION

An aspect of the invention is an internal gear pump in which the pumping direction can be switched and which exhibits an effective lubrication of rotating parts within the pump.

One aspect of the invention relates to an internal gear pump for forward and reverse operations, comprising: a pump housing which comprises a first fluid port and a second fluid port, wherein in a first rotational direction, the first fluid port is formed as a fluid outlet or pressure port and the second fluid port is formed as a fluid inlet or suction port, and in a second rotational direction, the first fluid port is formed as a fluid inlet or suction port and the second fluid port is formed as a fluid outlet or pressure port; an internal gear and an external gear which together form delivery cells in order to deliver a fluid; a first rotary bearing which mounts the internal gear; and a second rotary bearing which mounts the external gear; wherein a lubricant feed of the internal gear pump sets a fluid flow or lubricant flow between the fluid ports through the two rotary bearings in both rotational directions. Advantageously, the lubricant feed sets a partial fluid flow from the first fluid port to the second fluid port through the two rotary bearings in the first rotational direction and sets a partial fluid flow from the second fluid port to the first fluid port through the two rotary bearings in the second rotational direction. The lubricant feed preferably diverts the fluid flow or lubricant flow from the fluid delivered by the internal gear pump. In the first rotational direction, the lubricant feed preferably channels the fluid or lubricant from the first fluid port or pressure port to the second fluid port or suction port, i.e. from the pressure side of the internal gear pump to the suction side of the internal gear pump, through the two rotary bearings. In the second rotational direction, the lubricant feed preferably channels the fluid or lubricant from the second fluid port or pressure port to the first fluid port or suction port, i.e. from the pressure side of the internal gear pump to the suction side of the internal gear pump, through the two rotary bearings. The lubricant feed supplies the first rotary bearing and the second rotary bearing with the fluid or lubricant in both rotational directions.

The internal gear pump is preferably provided for delivering a fluid. The delivered fluid can be a lubricant and/or coolant or an actuating means. The internal gear pump is advantageously provided for a motor vehicle, in order for example to deliver or provide the fluid for lubricating and/or cooling a drive motor of the motor vehicle or for actuating a transmission of the motor vehicle. The term "provided" is in particular intended to be understood to specifically mean "programmed", "formed", "designed", "configured", "fitted" and/or "arranged".

The internal gear and the external gear are preferably arranged eccentrically with respect to each other in a pump space, such that the rotary axes of the internal gear and the external gear which are aligned parallel to each other do not coincide but are rather spaced from each other. The end-facing sides of the pump space, and therefore the end-facing sides of the delivery cells, are sealed by a lid or, respectively, a base. Preferably, the fluid ports are fluidically connected to the pump space and therefore to the delivery cells. The fluid ports advantageously emerge into the pump space and therefore into the delivery cells.

The lubricant feed preferably comprises at least one channeling structure which exhibits a reduced flow resistance and which is provided in order to specifically guide the diverted fluid along a flow path through the internal gear pump. Due to the reduced flow resistance of the channeling structure, a flow path through the internal gear pump is specifically predetermined for the fluid. On its flow path through the internal gear pump, the fluid passes at least one lubricating location which has to be supplied with lubricant; in particular, the fluid passes at least the first rotary bearing and the second rotary bearing on its flow path.

The internal gear pump or the pump space comprises a base which axially delineates the pump space and the delivery cells, wherein the lubricant feed comprises a channeling structure in the internal gear and a channeling structure in the base. The channeling structures in the internal gear and in the base are preferably connected to each other fluidically.

The channeling structure which is formed in the internal gear is preferably delineated by the material of the internal gear; the channeling structure which is formed in the base is preferably delineated by the material of the base. The channeling structure in the internal gear and the channeling structure in the base can radially and/or axially overlap each other, i.e. the fluid from the channeling structure in the internal gear can flow at least substantially directly into the channeling structure which is formed in the base, or vice versa, depending on the rotational direction of the pump. The terms "radially" and "axially" refer in particular to the rotary axis of the internal gear and/or the external gear, such that the expression "axially" denotes a direction which extends on the rotary axis or parallel to the rotary axis, and the expression "radially" denotes a direction which extends perpendicular to the rotary axis.

The internal gear and the base can form an axial sealing gap. The axial sealing gap is arranged radially between the delivery cells and the channeling structure in the internal gear and radially between the delivery cells and the channeling structure in the base. The axial sealing gap formed by the internal gear and the base seals the delivery cells off from the channeling structure in the internal gear and from the channeling structure in the base. The axial sealing gap formed by the internal gear and the base preferably does not comprise a channeling structure, i.e. advantageously exhibits a flow resistance which is higher than that of the channeling structure in the internal gear and the channeling structure in the base, whereby the fluid flows at least substantially between the channeling structure in the internal gear and the channeling structure in the base and not between the channeling structures and the delivery cells.

The channeling structure in the internal gear is preferably provided in order to guide the fluid through the internal gear, in particular axially. The channeling structure in the base is preferably provided in order to guide the fluid through the base, in particular axially. The channeling structure in the internal gear and/or the channeling structure in the base is/are preferably formed as an axial passage opening. A diameter of the passage opening in the internal gear can be equal or different to a diameter of the passage opening in the base. The axial passage openings can comprise one passage channel or more than one passage channel.

The longitudinal axes of the passage openings or passage channels are preferably arranged substantially parallel to or on the rotary axis.

The passage opening of the lubricant feed breaches the base, preferably in the region of the passage opening of the internal gear which is positioned in the pump space. The passage opening in the base preferably emerges into the passage opening of the internal gear, such that the fluid transitions directly from the passage opening in the base into the passage opening in the internal gear, or vice versa, depending on the rotational direction of the pump.

The passage opening in the base is preferably arranged substantially in the middle of the base and/or the external gear.

The passage openings are or extend in particular coaxially with respect to each other. The passage openings are preferably formed as bores which are latterly introduced into the internal gear and the base or into the external gear. The corresponding passage opening can also be produced in the manufacturing process, for example during casting, injection-molding, sintering or printing.

In preferred embodiments, the base is fixedly connected to the external gear and preferably formed integrally with the external gear. The external gear is advantageously formed to be cup-shaped. Preferably, the external gear and the base together form a cup-shaped pump space which is open on one side and into which the internal gear protrudes. The external gear and the base advantageously consist of the same material. The external gear and the base are preferably molded in or from one piece. Advantageously, the external gear and the base are formed together in a manufacturing method, for example in a casting method, a sintering method or an injection-molding method, or are manufactured/molded from one blank. Preferably, the external gear integrally forms the base.

If the base and external gear are formed integrally, the internal gear and the external gear can form the axial sealing gap which seals the delivery cells off from the channeling structure in the internal gear and the channeling structure in the base.

The lubricant feed can in particular comprise a channeling structure which fluidically connects the first fluid port and the first rotary bearing to each other and another channeling structure which fluidically connects the second fluid port and the second rotary bearing to each other.

The lubricant feed advantageously lacks an additional channeling structure which fluidically connects the first fluid port and the second rotary bearing to each other and another additional channeling structure which fluidically connects the second fluid port and the first rotary bearing to each other. The flow resistance between the first fluid port and the first rotary bearing is preferably smaller than a flow resistance between the first fluid port and the second rotary bearing. The flow resistance between the second fluid port and the second rotary bearing is preferably smaller than a flow resistance between the second fluid port and the first rotary bearing. The flow resistance between the first fluid port and the first rotary bearing is preferably smaller than a flow resistance between the second fluid port and the first rotary bearing. The flow resistance between the second fluid port and the second rotary bearing is preferably smaller than a flow resistance between the first fluid port and the second rotary bearing.

Due to the channeling structures, the fluid for lubricating is preferably forced along a defined flow path through the internal gear pump. In the first rotational direction, the fluid provided for lubricating flows at least substantially from the first fluid port into the first rotary bearing and not into the second rotary bearing and from the first rotary bearing through the internal gear and the base and not from the first rotary bearing to the second fluid port. In the second rotational direction, the fluid provided for lubricating flows at least substantially from the second fluid port into the second rotary bearing and not into the first rotary bearing and from the second rotary bearing through the base and the internal gear and not from the second rotary bearing to the first fluid port.

In the first rotational direction, this enforces a fluid flow from the first fluid port into the first rotary bearing. In the second rotational direction, this enforces a fluid flow from the second fluid port into the second rotary bearing. In the first rotational direction, it also at least substantially prevents the fluid provided for lubricating from flowing directly from the first rotary bearing to the second fluid port. In the second rotational direction, it also at least substantially prevents the fluid provided for lubricating from flowing directly from the second rotary bearing to the first fluid port.

The channeling structure which fluidically connects the first fluid port and the first rotary bearing to each other can be arranged in an axial sealing gap which is formed on the internal gear. The internal gear advantageously delineates the axial sealing gap. The internal gear preferably forms the axial sealing gap with the pump housing. The channeling structure which fluidically connects the first fluid port and the first rotary bearing to each other is advantageously formed in an axial end-facing surface of the pump housing which axially faces the internal gear and/or contacts the internal gear. The other channeling structure which fluidically connects the second fluid port and the second rotary bearing to each other can be arranged in an axial sealing gap which is formed on the external gear. The external gear advantageously delineates the axial sealing gap. The external gear preferably forms the axial sealing gap with the pump housing. The other channeling structure which fluidically connects the second fluid port and the second rotary bearing to each other is advantageously formed in an axial end-facing surface of the pump housing which axially faces the external gear and/or contacts the external gear.

The gear pump can also comprise an intermediate component which is arranged on the internally or external gear, in the region of the axial sealing gap, between the pump housing and the internally or external gear, whereby the axial sealing gap is formed by the internally or external gear and the intermediate component. The intermediate component can be assigned to the pump housing, wherein the intermediate component can also perform different functions to the pump housing, such as for example reducing friction, magnetically co-operating with the internally or external gear, compensating for an axial gap or the like. A sealing gap which is formed or delineated by or between the internally or external gear and the pump housing is therefore in particular also understood to mean a sealing gap which is formed or delineated by or between the internally or external gear and the intermediate component.

The lubricant feed can also comprise a first rotary bearing channeling structure, which extends in or through the first rotary bearing and is connected to the channeling structure which fluidically connects the first fluid port and the first rotary bearing to each other, and/or a second rotary bearing channeling structure which extends in or through the second rotary bearing and is connected to the other channeling structure which fluidically connects the second fluid port and the second rotary bearing to each other.

The first rotary bearing channeling structure can be arranged in a radial bearing gap, in particular a radial bearing gap of the first rotary bearing, which is formed by the internal gear and the pump housing. The first rotary bearing channeling structure is advantageously formed in a radial internal surface of the pump housing which radially faces the internal gear and/or contacts the internal gear. The radial internal surface of the pump housing which radially faces the internal gear and/or contacts the internal gear is preferably formed as a bearing surface and/or sliding surface for the internal gear and advantageously forms the first rotary bearing. The radial internal surface of the pump housing and a radial external surface of the internal gear which contacts the internal surface preferably form the first rotary bearing.

The second rotary bearing channeling structure can be arranged in a radial bearing gap, in particular a radial bearing gap of the second rotary bearing, which is formed by the external gear and the pump housing. The second rotary bearing channeling structure is advantageously formed in a radial internal surface of the pump housing which radially faces the external gear and/or contacts the external gear. The radial internal surface of the pump housing which radially faces the external gear and/or contacts the external gear is preferably formed as a bearing surface and/or sliding surface for the external gear and advantageously forms the second rotary bearing. The radial internal surface of the pump housing and a radial external surface of the external gear which contacts the internal surface preferably form the second rotary bearing.

At least one of the channeling structure, the other channeling structure, the first rotary bearing channeling structure and the second rotary bearing channeling structure can be formed as a groove in the pump housing. The groove is preferably open towards the respective axial sealing gap or radial bearing gap and/or towards the internal gear or external gear. The amount of lubricant can be set by configuring the groove, in particular its size.

The first rotary bearing and/or the second rotary bearing is/are preferably formed as a slide bearing.

In one embodiment, the internal gear pump can comprise a third rotary bearing, which mounts the external gear, and/or a centering device which centers the external gear. The external gear preferably comprises another radial bearing surface and/or a centering surface.

The external gear is preferably formed in a twin-cupped shape. The external gear is advantageously embodied in the shape of a cup on its two axial sides. The first axial side of the external gear forms a first cup space which is provided for accommodating the internal gear, and the second axial side of the external gear forms a second cup space which is provided for rotationally mounting and/or centering. The channeling structure in the base preferably connects the first cup space and the second cup space to each other fluidically.

The pump housing can form an axial sealing gap or an axial gap with the base, wherein the axial sealing gap or axial gap is fluidically connected to the channeling structure in the base. An axial end-facing surface of the external gear and/or base and an axial internal surface of the pump housing advantageously form an axial sealing gap or a gap. The channeling structure in the base preferably emerges into the sealing gap formed by the pump housing and the base or into the gap formed by the pump housing and the base. The fluid from the channeling structure in the base flows into the sealing gap formed by the pump housing and the base or into the gap formed by the pump housing and the base, or vice versa, depending on the rotational direction.

The lubricant feed can comprise a channeling structure which is axially delineated by the base and the pump housing and fluidically connected to the channeling structure in the base. The sealing gap formed by the pump housing and the base can comprise the channeling structure. The gap formed by the pump housing and the base can form the channeling structure.

Preferably, the internal gear and/or the external gear is or can be connected/coupled to a drive. The internal gear and/or the external gear advantageously comprise(s) a drive coupling region which is or can be connected/coupled to the drive. The drive coupling region is preferably formed integrally with the internal gear or the external gear. The internal gear pump advantageously comprises the drive coupling region, wherein the drive coupling region is formed by the part of the external gear forming the second cup space and/or by the part of the external gear forming the rotationally mounting device and/or centering device.

The external gear and the drive coupling region advantageously consist of the same material. The external gear and the drive coupling region are preferably molded in or from one piece. Advantageously, the external gear and the drive coupling region are formed together in a manufacturing method, for example in a casting method, a sintering method or an injection-molding method, or are manufactured/molded from one blank. Preferably, the external gear integrally forms the drive coupling region.

The internal gear and/or the external gear can be formed, at least in regions, from a magnetized or magnetizable material and in particular a magnetized or magnetizable plastic. For drive purposes, at least the drive coupling region of the internal gear or external gear is formed from the magnetized or magnetizable material and in particular a magnetized or magnetizable plastic. Preferably, the internal gear and/or external gear is completely made of the magnetized or magnetizable material.

The internal gear and/or the external gear is/are preferably formed from a magnetized composite material, in particular a particle composite material. The magnetized or magnetizable material consists of a non-magnetic substrate material in which magnetizable or magnetized powder/particles, for example soft iron powder/particles, is/are embedded. Magnetic and electrical properties can be specifically set by the proportion, shape and distribution of the magnetizable or magnetized powder/particles.

The internal gear pump can also comprise an electric coil for rotary-driving the internal gear and/or external gear. The drive coupling region of the internal gear and/or external gear is or can be connected/coupled to the electric coil. The internal gear pump is preferably formed as an electrically driven internal gear pump.

The magnetized or magnetizable material can be magnetized in such a way that the external gear which consists of the magnetized or magnetizable material at least in regions, and/or the internal gear which consists of the magnetized or magnetizable material at least in regions, can be rotary-driven by the electric coil. The external gear and/or the internal gear can be driven in the first rotational direction or the second rotational direction, depending on the supply of current passed through the coil.

The magnetized or magnetizable material can also be magnetized in such a way that the external gear which consists of the magnetized or magnetizable material at least in regions, and/or the internal gear which consists of the magnetized or magnetizable material at least in regions, is/are axially pressed and/or drawn against the axial sealing gaps by the electric coil, thus axially compensating the sealing gaps magnetically. The channeling structures ensure that a particular amount can flow through the axial sealing gaps, in particular when the sealing gaps are axially compensated by corresponding magnetization.

The magnetized or magnetizable material can also be magnetized in such a way that the external gear which consists of the magnetized or magnetizable material at least in regions, and/or the internal gear which consists of the magnetized or magnetizable material at least in regions, can be magnetically centered with respect to each other and/or with respect to the pump housing by the electric coil. The magnetic centering device can also be set by permanent magnets, for example when the pump is driven mechanically. To this end, the electric coil can for example be replaced with one or more permanent magnets, or the internal gear pump can comprise one or more permanent magnets in addition to the coil, in particular for centering.

The internal gear preferably consists of one part. The internal gear advantageously comprises external teeth and the radial external surface for forming the first rotary bearing. The external gear preferably consists of one part. The external gear advantageously comprises internal teeth and the radial external surface for forming the second rotary bearing. Particularly advantageously, the external gear additionally comprises the base and/or the drive coupling region and/or a radial internal or external surface for forming the third rotary bearing and/or the centering device.

Consisting "of one part" is in particular intended to be understood to mean "formed from the same material and/or in or from one piece" and in particular "formed or shaped together in a manufacturing method, for example in a casting method, a sintering method or an injection-molding method, or from one blank". Integrally formed components are preferably formed integrally with each other.

The external gear also advantageously comprises a circumferential radial widening which forms another axial sealing gap with the pump housing. The second rotary bearing and the third rotary bearing and/or the centering device of the external gear preferably exhibit different bearing diameters and/or centering diameters.

In the following, an example embodiment of an inventive internal gear pump is described on the basis of figures, without thereby restricting the scope of an aspect of the invention to the internal gear pump shown in the figures.

BRIEF DESCRIPTION OF THE DRAWINGS

Features essential to aspects of the invention which can only be gathered from the figures can advantageously develop the subject-matter of aspects of the invention, individually or in combinations, and form part of the scope of the disclosure.

The individual figures show.

DETAILED DESCRIPTION OF THE INVENTION

Figure 1:
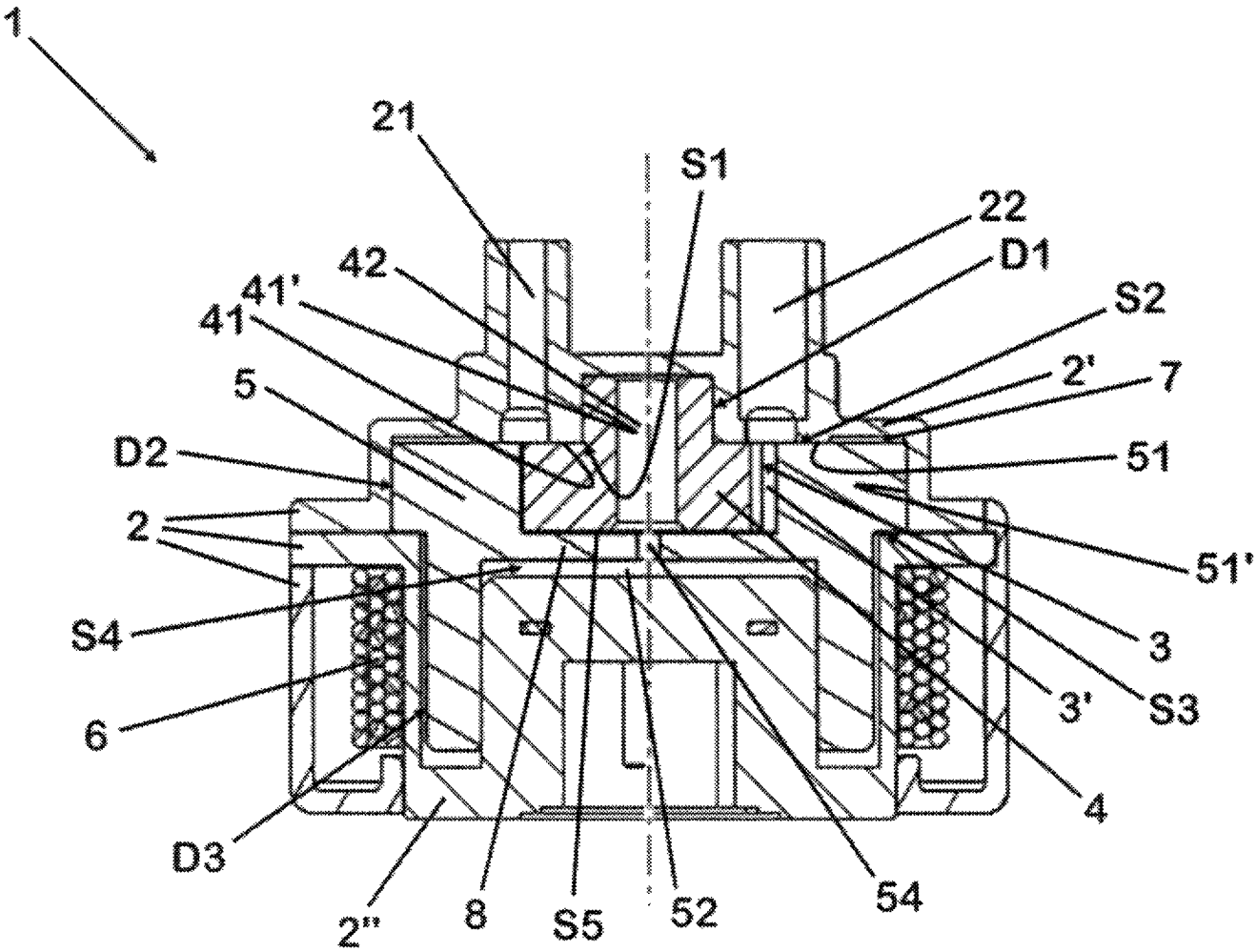
FIG. 1 an internal gear pump, in a longitudinal section.

FIG. 1 shows an example embodiment of an internal gear pump 1 in accordance with an aspect of the invention. The internal gear pump 1 comprises a first fluid port 21 and a second fluid port 22. The internal gear pump 1 is a reversible pump which can be driven in a first rotational direction and in a second rotational direction which is different from the first rotational direction, i.e. the first fluid port 21 is a fluid inlet or a fluid outlet, depending on the rotational direction of the internal gear pump 1. The second fluid port 22 correspondingly forms the fluid outlet or the fluid inlet of the internal gear pump 1.

From the fluid inlet into the pump 1, the fluid enters a pump space 3 through a pump chamber inlet and leaves the pump space 3 through a pump chamber outlet which is fluidically connected to the fluid outlet, i.e. to the first fluid port 21 or the second fluid port 22.

The internal gear pump 1 has a pump housing or a housing 2 which forms the first fluid port 21 and the second fluid port 22. An internal gear 4 and an external gear 5 are arranged in the housing 2, wherein the external gear 5 is or can be connected to a drive in order to drive the internal gear pump 1. The external gear 5 is the drive gear and the internal gear 4 is the output gear. The internal gear 4 and the external gear 5 are respectively formed as a rotor. Additionally or alternatively, the internal gear 4 can be driven by means of a drive. It is in principle conceivable for the internal gear 4 or the external gear 5 to be formed as a stator.

The external gear 5 is formed to be cup-shaped, comprising a base 8 which forms an axial end-facing wall of the pump space 3, i.e. the pump space 3 is delineated by the external gear 5 together with the housing 2 or, respectively, a lid of the housing 2.

The internal gear 4 is arranged in the pump space 3, wherein a rotary axis of the internal gear 4 and a rotary axis of the external gear 5 extend parallel to each other but do not coincide, i.e. the internal gear 4 is mounted eccentrically in the pump chamber 3. The external gear 5 and the internal gear 4 are in engagement with each other and form delivery cells 3' which transport the fluid from the pump space inlet to the pump space outlet, i.e. from the fluid inlet to the fluid outlet, wherein the delivery cells 3' alter their volume due to the eccentric arrangement of the internal gear 4 with respect to the external gear 5, such that an increase in pressure in the fluid occurs as the fluid is transported through the pump space 3.

The internal gear 4 has a central passage bore 42, and a passage opening 54 is formed in the base 8 of the external gear 5. A substantially circumferential cavity 7 is also formed in the housing 2, wherein an upper end-facing side of the external gear 5 cannot abut an internal wall of the housing 2 in the region of the cavity 7, such that no adhesion forces or friction forces between the external gear 5 and the housing 2 can occur in this region.

In accordance with an aspect of the invention, the internal gear pump 1 comprises a lubricant feed which—independently of the rotational direction of the internal gear pump 1—sets a fluid flow which channels a lubricant, preferably a part of the fluid being delivered, through two rotary bearings D1, D2, wherein the first rotary bearing D1 mounts the internal gear 4 and the second rotary bearing D2 mounts the external gear 5. The first rotary bearing D1 is formed by a radial external side of the internal gear 4 and an internal surface of the housing 2 which lies opposite said radial external side. The second rotary bearing D2 is formed by a radial external side of the external gear 5 and an internal surface of the housing 2 which lies opposite said radial external side.

In both rotational directions, the lubricant flows through the lubricant feed from the fluid outlet, the first fluid port 21 or the second fluid port 22, into a channeling structure 41, 51 which is formed in an axial sealing gap S1, S2 between the internal gear 4 and the housing 2 or between the external gear 5 and the housing 2. One of the axial sealing gaps—in this example embodiment, the axial sealing gap S2 which is formed between the external gear 5 and the housing 2—is enlarged in regions by the cavity 7, thus reducing friction, wherein one of the channeling structures—in this example embodiment, the channeling structure 51 which is formed in the axial sealing gap S2 between the external gear 5 and the housing 2—emerges into the cavity 7, such that the cavity 7 is filled with the lubricant. This further reduces friction. The lubricant is channeled in the channeling structures 41, 51, which are arranged in an axial sealing gap S1, S2, transverse to the rotational direction of the internal and external gears 4, 5.

The channeling structures 41, 51 which are formed in an axial sealing gap S1, S2 are respectively adjoined by a channeling structure 41', 51' which is formed in a radial sealing gap or radial bearing gap between the internal gear 4 and the housing 2 or between the external gear 5 and the housing 2. The adjoining channeling structures 41', 51' are respectively formed in a rotary bearing D1, D2. These channeling structures 41', 51' channel the lubricant in an axial direction along a radial external side of the internal gear 4 or, respectively, the external gear 5. The channeling structure 41' guides the lubricant through the first rotary bearing D1 for the internal gear 4 along the bearing surface, thus supplying the first rotary bearing D1 with the lubricant. The channeling structure 51' guides the lubricant through the second rotary bearing D2 for the external gear 5 along the bearing surface, thus supplying the second rotary bearing D2 with the lubricant.

Between the channeling structures 41', 51' which are formed in the radial sealing gap or radial bearing gap, the lubricant is channeled through the internal gear 4, the base 8 of the external gear 5, along the base 8 of the external gear 5, through a third rotary bearing and centering device D3 for the external gear 5, along the bearing and centering surface and through another axial sealing gap or axial gap S3 between the external gear 5 and the housing 2. The lubricant is guided through a channeling structure 42 in the internal gear 4, a channeling structure 54 in the base 8, a channeling structure 52 along the base 8, along the bearing and centering surface of the third rotary bearing and centering device D3 and along the other axial sealing gap or axial gap S3, whereby the lubricant can flow from the first rotary bearing D1 to the second rotary bearing D2 and vice versa. The channeling structure 42 in the internal gear 4 and the channeling structure 54 in the base 8 are respectively formed as a passage bore. The channeling structure 52 along the base 8 is formed as a gap S4 between the base 8 and the housing 2. The bearing and centering surface of the third rotary bearing and centering device D3, and the other axial sealing gap or axial gap S3, do not comprise any dedicated channeling structures in order to guide the lubricant. The lubricant flows due to leakage along the bearing and centering surface of the third rotary bearing and centering device D3 and along the other axial sealing gap or axial gap S3. In principle, the bearing and centering surface of the third rotary bearing and centering device D3 and/or the other axial sealing gap or axial gap S3 can comprise or form a channeling structure, for example a groove or a gap. The axial sealing gaps S2, S3 between the external gear 5 and the housing 2 are formed on opposite axial sides of the external gear 5.

The third rotary bearing and centering device D3 of the external gear 5 projects annularly from the lower end-facing side of the external gear 5 and extends parallel to the rotary axis of the external gear 5. The external gear 5 is formed in a twin-cupped shape. On the first axial side of the external gear 5, the external gear 5 comprises a first cup space in which the internal gear 4 is arranged or into which the internal gear 4 protrudes. On the second axial side of the external gear 5, the external gear 5 comprises a second cup space in which a part of the housing 2 is arranged or into which the housing 2 protrudes, for rotationally mounting and/or centering.

It follows from the above that the flow path for the lubricant through the internal gear pump 1 is identical, irrespective of the rotational direction in which the gears 4, 5 are rotated; only the flow direction of the lubricant changes with the rotational direction of the internal gear pump 1.

A channeling structure can be embodied as a groove or cavity, wherein the groove or cavity is preferably formed in the housing 2, since the housing 2 is in principle designed as a stator. Depending on the manner in which the housing 2 is produced, the groove or cavity is latterly introduced into the housing 2 or is cast, injection-molded, sintered, printed, etc. together with the housing 2. In this example embodiment, the channeling structures 41, 41', 51, 51' are formed as grooves. Alternatively, a channeling structure can be embodied as a gap which is formed or delineated by arranging at least two components at a distance from each other. In this example embodiment, the channeling structure 52 is formed as a gap 54. If a leakage flow is sufficient for the flow of lubricant, channeling structures can be omitted. An amount of the lubricant can be influenced by configuring the respective channeling structure, for example its depth, width, profile, etc.

The first axial sealing gap S1 is formed axially between the internal gear 4 and the housing 2. The channeling structure 41 is arranged in the first axial sealing gap S1 and connects the first axial sealing gap S1 to the first fluid port 21 and/or to the delivery cells 3' connected to the first fluid port 21. When the first fluid port 21 is arranged on the pressure side of the internal gear pump 1 and therefore forms a fluid outlet (the first rotational direction), lubricant flows through the channeling structure 41 into the first axial sealing gap S1 and on to the first rotary bearing D1, thus supplying the first rotary bearing D1 with lubricant. When the first fluid port 21 is arranged on the suction side of the internal gear pump 1 and therefore forms a fluid inlet (the second rotational direction), lubricant flows through the channeling structure 41 from the first axial sealing gap S1 to the first fluid port 21 and/or to the delivery cells 3' connected to first fluid port 21. The first axial sealing gap S1 lacks a channeling structure connecting the first axial sealing gap S1 to the second fluid port 22 and/or to the delivery cells 3' connected to the second fluid port 22. This ensures that in the first rotational direction, the lubricant does not flow directly from the first rotary bearing D1 to the second fluid port 22, which is formed as a fluid inlet, via the first axial sealing gap S1, but rather flows to the second fluid port 22 circuitously through the internal gear 4, the base 8 and the second rotary bearing D2.

The second axial sealing gap S2 is formed axially between the external gear 5 and the housing 2. The channeling structure 51 is arranged in the second axial sealing gap S2 and connects the second axial sealing gap S2 to the second fluid port 22 and/or to the delivery cells 3' connected to the second fluid port 22. When the second fluid port 22 is arranged on the pressure side of the internal gear pump 1 and therefore forms a fluid outlet (the second rotational direction), lubricant flows through the channeling structure 51 into the second axial sealing gap S2 and on to the second rotary bearing D2, thus supplying the second rotary bearing D2 with lubricant. When the second fluid port 22 is arranged on the suction side of the internal gear pump 1 and therefore forms a fluid inlet (the first rotational direction), lubricant flows through the channeling structure 51 from the second axial sealing gap S2 to the second fluid port 22 and/or to the delivery cells 3' connected to second fluid port 22. The second axial sealing gap S2 lacks a channeling structure connecting the second axial sealing gap S2 to the first fluid port 21 and/or to the delivery cells 3' connected to the first fluid port 21. This ensures that in the second rotational direction, the lubricant does not flow directly from the second rotary bearing D2 to the first fluid port 21, which is formed as a fluid inlet, via the second axial sealing gap S2, but rather flows to the first fluid port 21 circuitously through the second rotary bearing D2, the base 8 and the internal gear 4.

The axial sealing gap S5 is formed axially between the internal gear 4 and the base 8 of the external gear 5. In both rotational directions, the axial sealing gap S5 separates the channeling structure 42 in the internal gear 4 and the channeling structure 54 in the base 8 from the pump space 3 and/or the delivery cells 3', thus preventing lubricant from flowing from the channeling structures 42, 54 to the pump space 3 and/or delivery cells 3' and from the pump space 3 and/or delivery cells 3' to the channeling structures 42, 54.

The channeling structures 41, 41' are formed on the pump housing 2. The internal gear 4 and the pump housing 2 form the first axial sealing gap S1. The channeling structure 41 is arranged in the region of the pump housing 2 in which the first axial sealing gap S1 is formed. The channeling structure 41 is open towards the first axial sealing gap S1. The first axial sealing gap S1 is arranged radially between the delivery cells 3' and the first rotary bearing D1. The first axial sealing gap S1 is arranged radially between the fluid ports 21, 22 and the first rotary bearing D1. Via the first axial sealing gap S1, the channeling structure 41 establishes a fluidic connection between the first fluid port 21 and/or the delivery cells 3' connected to the first fluid port 21 and the first rotary bearing D1. A corresponding connection (via a groove or the like) between the second fluid port 22 and the first rotary bearing D1 is not provided.

The channeling structure 41' is formed in the first rotary bearing D1, in particular a slide bearing. The internal gear 4 and the pump housing 2 form a radial sealing gap or radial bearing gap in the first rotary bearing D1. The channeling structure 41' is arranged in the region of the pump housing 2 in which the radial sealing gap or bearing gap is formed. The channeling structure 41' is open towards the radial sealing gap or bearing gap. The channeling structure 41 and the channeling structure 41' emerge into each other. Via the axial sealing gap S1 and the radial sealing gap or bearing gap and/or the rotary bearing D1, the channeling structures 41, 41' establish a fluidic connection between the first fluid port 21 and the channeling structure 42 in the internal gear 4. A corresponding connection (via a groove or the like) between the second fluid port 22 and the channeling structure 42 in the internal gear 4 is not provided. The channeling structure 41' can also be omitted.

The channeling structures 51, 51' are formed on the pump housing 2. The external gear 5 and the pump housing 2 form the second axial sealing gap S2. The channeling structure 51 is arranged in the region of the pump housing 2 in which the second axial sealing gap S2 is formed. The channeling structure 51 is open towards the second axial sealing gap S2. The second axial sealing gap S2 is arranged radially between the pump space 3 or the delivery cells 3' and the second rotary bearing D2. The second axial sealing gap S2 is arranged radially between the fluid ports 21, 22 and the second rotary bearing D2. Via the second axial sealing gap S2, the channeling structure 51 establishes a fluidic connection between the second fluid port 22 and/or the delivery cells 3' connected to the second fluid port 22 and the second rotary bearing D2. A corresponding connection (via a groove or the like) between the first fluid port 21 and the second rotary bearing D2 is not provided.

The channeling structure 51' is formed in the second rotary bearing D2, in particular a slide bearing. The internal gear 4 and the pump housing 2 form a radial sealing gap or radial bearing gap in the second rotary bearing D2. The channeling structure 51' is arranged in the region of the pump housing 2 in which the radial sealing gap or bearing gap is formed. The channeling structure 51' is open towards the radial sealing gap or bearing gap. The channeling structure 51 and the channeling structure 51' emerge into each other. The second channeling structure 51' can also be omitted.

The external gear 5 and the pump housing 2 form the other axial sealing gap S3. The other axial sealing gap S3 is arranged radially between the second rotary bearing D2 and the third rotary bearing D3. A channeling structure can be formed in the other axial sealing gap S3, and a channeling structure can also be formed in the third rotary bearing and centering device D3. The pump housing 2 comprises at least the channeling structure 41 and the channeling structure 51.

The pump housing 2 comprises a first housing part 2' and a second housing part 2". The first housing part 2' comprises or forms the first rotary bearing D1 and the second rotary bearing D2. The first housing part 2' also comprises or forms the first axial sealing gap S1 with the internal gear 4 and the second axial sealing gap S2 with the external gear 5. The first housing part 2' also comprises or forms the fluid ports 21, 22 and seals the pump space 3 on its end-facing side. The second housing part 2" comprises or forms the third rotary bearing and centering device D3. The second housing part 2" protrudes into the second cup space of the external gear 5, for mounting and/or centering the external gear 5. The second housing part 2" also comprises or forms the other axial sealing gap S3 with the external gear 5.

The internal gear pump 1 also comprises an electric coil 6 which is arranged on the outside of the housing 2 and surrounds the third rotary bearing and centering device D3 outside the housing 2. The external gear 5 consists entirely or at least in regions of a magnetized material. The external gear 5 consists entirely or at least in regions of a magnetized plastic.

The magnetized material consists of a plastic in which magnetized particles, preferably soft iron particles, are embedded. Magnetic and electrical properties can be specifically set by the proportion, shape and distribution of the magnetized particles in the plastic.

The magnetized material is magnetized in such a way that the external gear 5 can be rotary-driven by the electric coil 6. The external gear 5 is driven in the first rotational direction or the second rotational direction, depending on the supply of current passed through the coil 6.

The magnetized material is also magnetized in such a way that the external gear 5 is axially pressed and/or pushed against at least the second axial sealing gap S2 by the electric coil 6, thus axially compensating the sealing gap S2, wherein the external gear 5 is pressed and/or pushed against the axial sealing gap S5 and the internal gear 4 is thereby pressed and/or pushed against the first axial sealing gap S1, thus axially compensating the sealing gap S1. The channeling structure 41 in the first sealing gap S1 and the channeling structure 51 in the second sealing gap ensure that a particular amount of lubricant can flow through the axial sealing gaps S1, S2, even when the sealing gaps S1, S2 are axially compensated by corresponding magnetization.

The magnetized material can in principle be magnetized in such a way that the external gear 5 is magnetically centered with respect to the pump housing 2 by the electric coil 6. The magnetic centering device can also be set by permanent magnets, for example when the pump 1 is driven mechanically, wherein the electric coil 6 is replaced with one or more permanent magnets.

Figure 2:
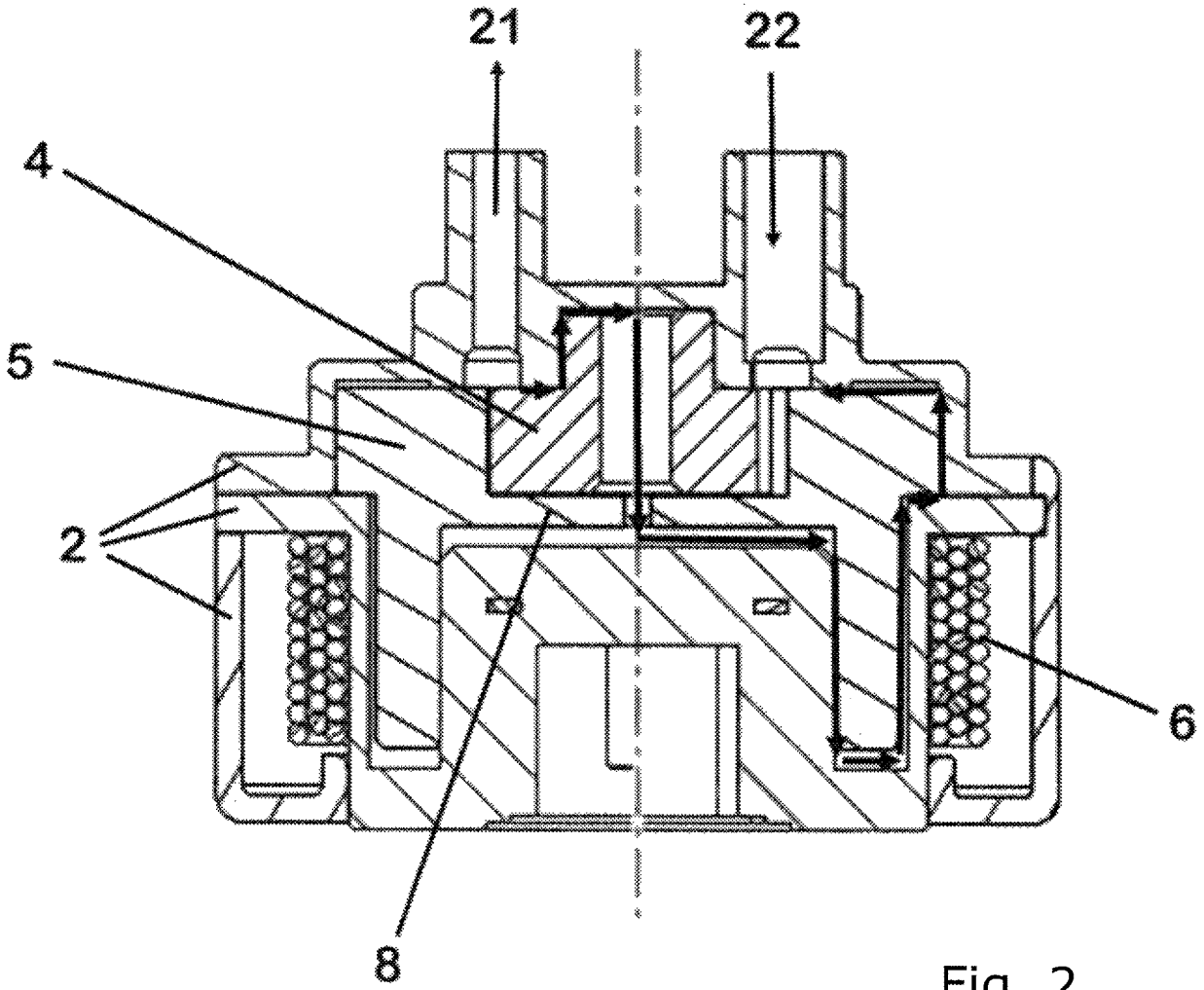
FIG. 2 a flow path of the lubricant when the internal gear pump is being driven in a first rotational direction.
Figure 3:
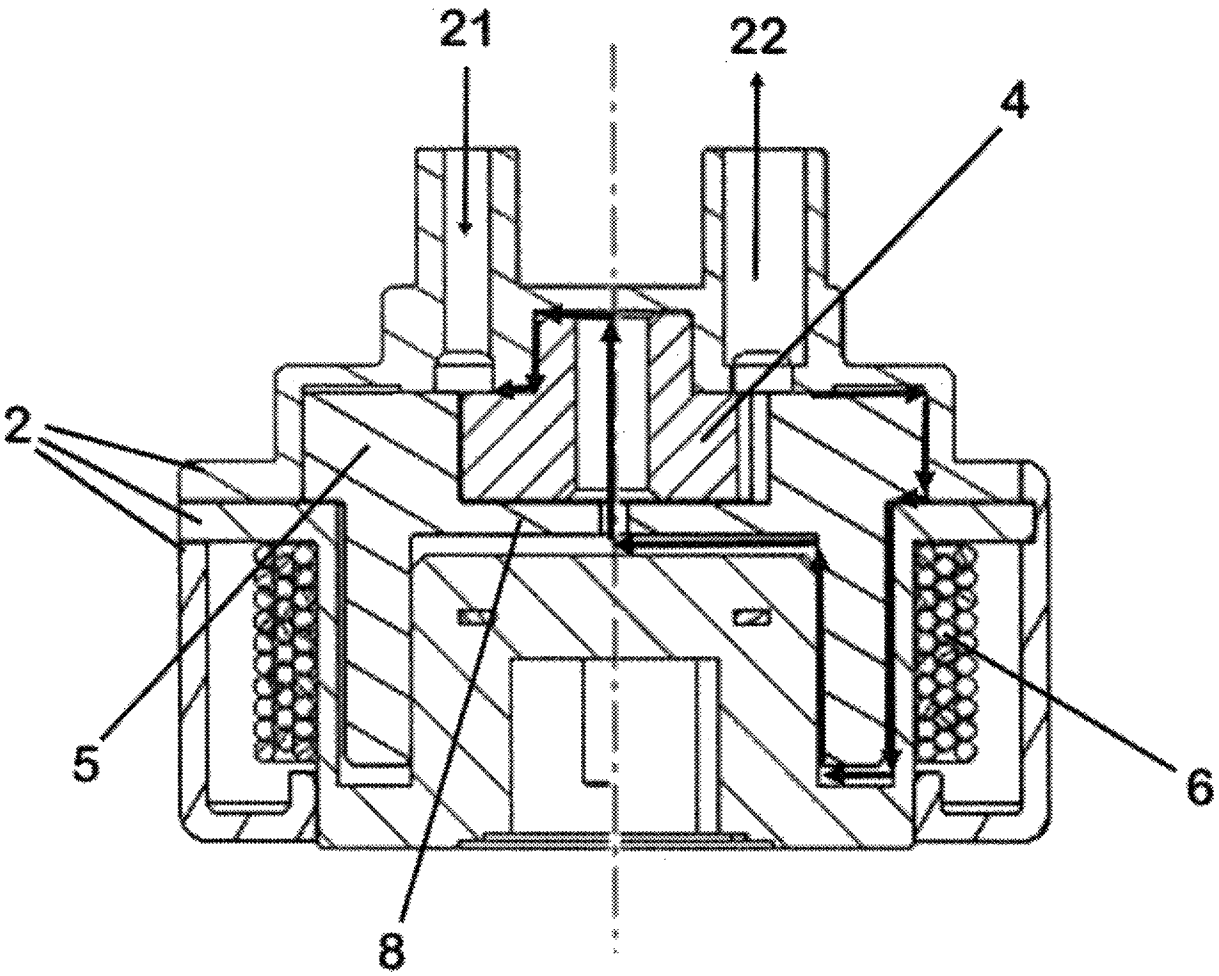
FIG. 3 a flow path of the lubricant when the internal gear pump is being driven in a second rotational direction which is opposite to the first rotational direction.

FIG. 2 shows the lubricant path in the first rotational direction. In the first rotational direction, the first fluid port 21 is arranged on the pressure side of the internal gear pump 1 and therefore formed as a fluid outlet or pressure port, and the second fluid port 22 is arranged on the suction side of the internal gear pump 1 and therefore formed as a fluid inlet or suction port. FIG. 3 shows the lubricant path in the second rotational direction. In the second rotational direction, the second fluid port 22 is arranged on the pressure side of the internal gear pump 1 and therefore formed as a fluid outlet or pressure port, and the first fluid port 21 is arranged on the suction side of the internal gear pump 1 and therefore formed as a fluid inlet or suction port.

In the first rotational direction, a first lubricant flow from the first fluid port 21 to the second fluid port 22 is set by the lubricant feed, as shown in FIG. 2. In this case, the lubricant feed comprises the following flow paths:

a first flow path which extends radially through the first axial sealing gap S1 or along the first axial sealing gap S1, between the internal gear 4 and the pump housing 2, to the first rotary bearing D1. The first flow path extends along the channeling structure 41 to the first rotary bearing D1.

a second flow path which extends axially through the first rotary bearing D1 or along the first rotary bearing D1. The second flow path extends along the channeling structure 41'.

a third flow path which extends axially through the internal gear 4. The third flow path extends along or through the channeling structure 42 in the internal gear 4.

a fourth flow path which extends axially through the base 8. The fourth flow path extends through or along the channeling structure 54 in the base 8.

a fifth flow path which extends radially along the base 8. The fifth flow path extends through or along the axial gap S4 formed between the base 8 and the pump housing 2. The fifth flow path extends along the channeling structure 52 which is axially delineated by the base 8 and the pump housing 2.

a sixth flow path which extends through or along the third rotary bearing and centering device D3. The lubricant feed can comprise a channeling structure, which extends through or along the third rotary bearing and centering device D3, for the sixth flow path. The channeling structure can comprise a groove in a radial sealing gap, which is formed between the external gear 5 and the pump housing 2, and/or a radial/axial gap which is formed between the external gear 5 and the pump housing 2. The channeling structure can be axially and/or radially delineated by the external gear 5 and the pump housing 2.

a seventh flow path which extends radially through or along the other axial sealing gap S3, between the external gear 5 and the pump housing 2, to the second rotary bearing D2.

an eighth flow path which extends axially through or along the second rotary bearing D2. The eighth flow path extends along the channeling structure 51'.

a ninth flow path which extends radially through or along the second axial sealing gap S2, between the external gear 5 and the pump housing 2, to the second fluid port 22. The ninth flow path extends along the channeling structure 51 to the second fluid port 22.

If the internal gear pump 1 does not comprise a third rotary bearing and centering device for the external gear 5, then the sixth flow path is omitted.

In the second rotational direction, a second lubricant flow from the second fluid port 22 to the first fluid port 21, which extends back along the flow path of the first lubricant flow, is set by the lubricant feed.

The invention claimed is:

1. An internal gear pump for forward and reverse operations, comprising:

a pump housing which comprises a first fluid port and a second fluid port, wherein in a first rotational direction, the first fluid port is formed as a fluid outlet and the second fluid port is formed as a fluid inlet, and in a second rotational direction, the first fluid port is formed as a fluid inlet and the second fluid port is formed as a fluid outlet;

an internal gear and an external gear which together form delivery cells in order to deliver a fluid;

a first rotary bearing which mounts the internal gear;

a second rotary bearing which mounts the external gear; and a lubricant feed which sets a fluid flow between the fluid ports through the two rotary bearings in both rotational directions, wherein a flow resistance between the first fluid port and the first rotary bearing is smaller than a flow resistance between the first fluid port and the second rotary bearing, and a flow resistance between the second fluid port and the second rotary bearing is smaller than a flow resistance between the second fluid port and the first rotary bearing.

2. The internal gear pump according to claim 1, wherein the lubricant feed comprises at least one channeling structure which exhibits a reduced flow resistance and which is provided in order to specifically guide the fluid along a flow path through the internal gear pump.

3. The internal gear pump according to claim 1, further comprising a base which axially delineates the delivery cells, wherein the lubricant feed comprises a channeling structure in the internal gear and a channeling structure in the base which are connected to each other fluidically.

4. The internal gear pump according to claim 3, wherein the channeling structure in the internal gear and/or the channeling structure in the base is/are formed as an axial passage opening.

5. The internal gear pump according to claim 3, wherein the base is fixedly connected to the external gear.

6. The internal gear pump according to claim 1, wherein the lubricant feed comprises a channeling structure which fluidically connects the first fluid port and the first rotary bearing to each other and a channeling structure which fluidically connects the second fluid port and the second rotary bearing to each other.

7. The internal gear pump according to claim 6, wherein the channeling structure which fluidically connects the first fluid port and the first rotary bearing to each other is arranged in an axial sealing gap which is formed on the internal gear, and/or the channeling structure which fluidically connects the second fluid port and the second rotary bearing to each other is arranged in an axial sealing gap which is formed on the external gear.

8. The internal gear pump according to claim 6, wherein the lubricant feed comprises a channeling structure, which extends in or through the first rotary bearing and is connected to the channeling structure which fluidically connects the first fluid port and the first rotary bearing to each other, and/or a channeling structure which extends in or through the second rotary bearing and is connected to the channeling structure which fluidically connects the second fluid port and the second rotary bearing to each other.

9. The internal gear pump according to claim 6, wherein at least one of the channeling structures s formed as a groove in the pump housing.

10. The internal gear pump according to claim 1, further comprising a third rotary bearing, which mounts the external gear, and/or a centering device which centers the external gear.

11. The internal gear pump according to claim 1, wherein the pump housing forms an axial sealing gap or an axial gap with the base.

12. The internal gear pump according to claim 1, wherein the lubricant feed comprises a channeling structure which is axially delineated by the base and the pump housing.

13. The internal gear pump according to claim 1, wherein the internal gear and/or the external gear is/are formed, at least in regions, from a magnetized material.

14. The internal gear pump according to claim 1, characterized by an electric coil for rotary-driving the internal gear and/or external gear.

15. The internal gear pump according to claim 3, wherein the base is formed integrally with the external gear.

16. The internal gear pump according to claim 1, wherein the lubricant feed lacks a channeling structure which fluidically connects the first fluid port and the second rotary bearing to each other and a channeling structure which fluidically connects the second fluid port and the first rotary bearing to each other.

17. The internal gear pump according to claim 1, wherein the internal gear and/or the external gear is/are formed, at least in regions, from a magnetized plastic.

* * * * *